United States Patent [19]

Hanyu et al.

[11] 4,196,682

[45] Apr. 8, 1980

[54] FEED ADJUSTING DEVICE FOR SEWING MACHINES

[75] Inventors: Susumu Hanyu, Hachioji; Shiro Takei, Oume, both of Japan

[73] Assignee: Janome Sewing Machine Co. Ltd., Tokyo, Japan

[21] Appl. No.: 841,463

[22] Filed: Oct. 12, 1977

[30] Foreign Application Priority Data

Feb. 2, 1977 [JP] Japan ..... 52-10507

[51] Int. Cl.[2] ..... D05B 3/02

[52] U.S. Cl. ..... 112/158 A; 112/314

[58] Field of Search ..... 112/158 A, 158 R, 210, 112/158 B, 314

[56] References Cited

U.S. PATENT DOCUMENTS

| | | | |
|---|---|---|---|
| 2,971,482 | 2/1961 | Koike | 112/158 A |
| 3,053,207 | 9/1962 | Adler | 112/158 R |
| 3,426,711 | 2/1969 | Kawaguchi | 112/158 R |
| 3,786,769 | 1/1974 | Coulombe | 112/158 A |
| 3,792,673 | 2/1974 | Branchi | 112/158 A |
| 3,834,332 | 9/1974 | Gude | 112/158 A |
| 4,048,932 | 9/1977 | Odermann et al. | 112/158 E |

FOREIGN PATENT DOCUMENTS

| | | | |
|---|---|---|---|
| 2609238 | 9/1976 | Fed. Rep. of Germany | 112/158 A |

*Primary Examiner*—Werner H. Schroeder
*Assistant Examiner*—Andrew M. Falik
*Attorney, Agent, or Firm*—Michael J. Striker

[57] ABSTRACT

A sewing machine provided with a set of pattern generating cams is also provided with a user-operated multi-setting pattern selector dial. When the selector dial is turned to a particular setting, to thereby cause the pattern generating cams to generate the corresponding pattern, a first mechanism automatically selects a respective feed pitch (amount of cloth feed per needle penetration), appropriate for the type of pattern selected. Accordingly, the user is not troubled to determine, by trial or error or otherwise, what feed pitch values would be clearly unsuitable for the selected pattern, and is instead automatically presented with a standard feed pitch value appropriate for the selected pattern. However, the user can also turn a second selector dial to increase the automatically selected standard feed pitch value by an amount up to 50% thereof, or alternatively to decrease the automatically selected feed pitch value by an amount up to 50% thereof, for example to take into account unusual thinness or thickness of the cloth being sewn on.

5 Claims, 10 Drawing Figures

FIG_10

ⓐ Blind stitches
ⓑ Three-point zigzag stitches
ⓒ Straight stitches
ⓕ Forward feed
ⓖ Backward feed

| | | A | B | C | D | E | F | G | H | I | J |
|---|---|---|---|---|---|---|---|---|---|---|---|
| Type of stitches / Zigzag amplitude & feed pitch | | ⓐ | ⓑ | ⓒ | Zigzag stitches | | | | Button-hole stitches | | |
| Zigzag amplitude | | 3.5 | 5 | 0 | 2 | 3 | 4 | 5 | 1.9 | 4.2 | 1.9 |
| Feed pitch | + 50 % | 1.5 | 1.2 | 3.6 | 1.5 | 1.8 | 2.1 | 2.4 | ⓕ 1.2 | 0 | ⓖ 1.2 |
| | Standard | 1 | 0.8 | 2.4 | 1 | 1.2 | 1.4 | 1.6 | ⓕ 0.8 | 0 | ⓖ 0.8 |
| | - 50 % | 0.5 | 0.4 | 1.2 | 0.5 | 0.6 | 0.7 | 0.8 | ⓕ 0.4 | 0 | ⓖ 0.4 |

FEED ADJUSTING DEVICE FOR SEWING MACHINES

Background of the invention:

The present invention relates to a feed adjusting device for sewing machines, in which a standard feed pitch most suited to each selected pattern is obtained simultaneously with the pattern selecting operation by a single operating dial and in which modified feed pitches can also be obtained for the selected pattern by operation of a separate operating dial. The expression feed pitch as herein employed designates the amount by which the cloth being sewn on is advanced by the sewing machine per needle minute penetration. The device of the invention is simple in structure and effectively operates to simultaneously select a desired one of different patterns and a standard feed pitch which is most suited and most frequently applied to the selected pattern. The standard feed pitches for the respective patterns can be modified within a range of predetermined ratio by the operator as desired.

Heretofore devices for simultaneously selecting a stitch pattern and a feed pitch for the pattern have been provided. Such conventional devices, however, have been very complex in structure and require many assembling steps. These devices, therefore, require a high cost, and also are complex operation.

This invention has been devised to eliminate such shortcomings and disadvantages of the prior art. It is a primary object of the invention to provide the device as a single structure at an economical cost.

It is another object of this invention to provide a device which is simple and exact in operation.

It is another object of this invention to provide a device offering not only a standard feed pitch in response to the selection of a stitch pattern but also offering modifications of the standard pitch.

The other features and advantages of this invention will be apparent from the following description of the preferred embodiments in reference to the attached drawings.

Brief description of the drawings

FIG. 10 is a table of different stitch patterns to be selected with the values of zigzag amplitude to be established for each automatically selected with the values of standard feed pitch and the user-selected modified feed pitches, indicated below the respective patterns.

Detailed description of the invention

Figure 1:
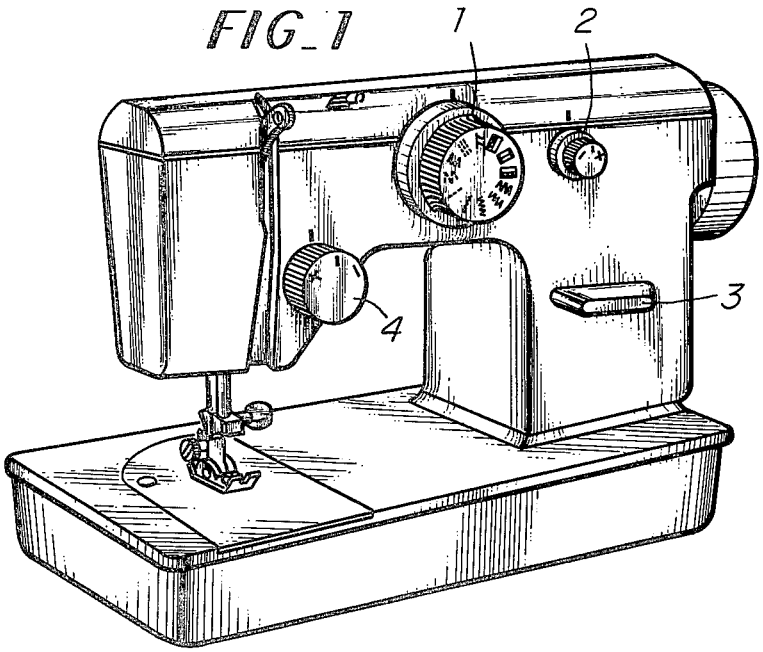
FIG. 1 shows the outer appearance of a sewing machine having a device embodying this invention.

The invention will discussed with reference to the attached drawings. In FIG. 1, reference numeral (1) denotes a dial operated to select a stitch pattern and to simultaneously select a standard feed pitch for the selected pattern. Reference numeral (2) is a dial separately operated to modify the standard feed pitch within a predetermined range of predetermined ratio relative to the standard feed pitch. Numeral (3) is a lever for back stitching and for darning stitches. Numeral (4) is a dial for regulating the upper thread tension.

Figure 2:
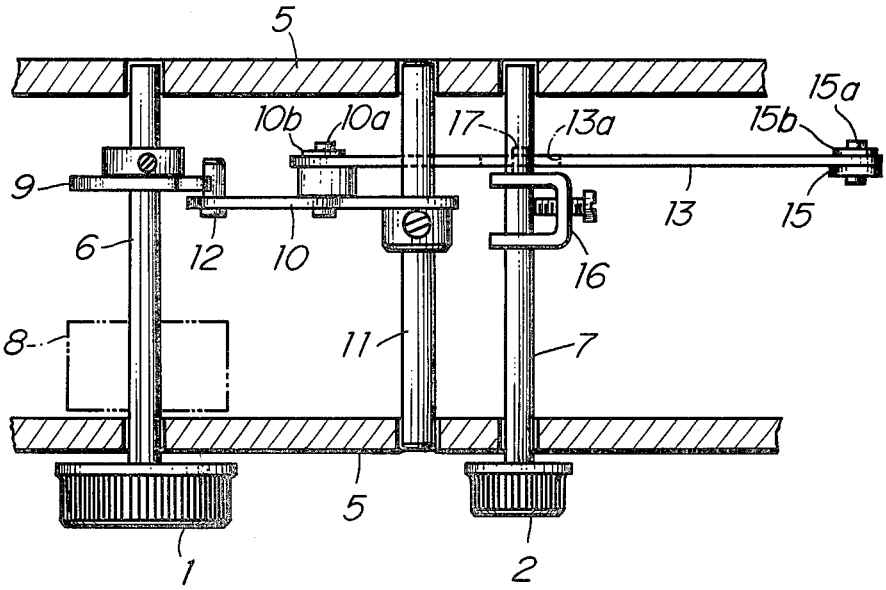
FIG. 2 is a plan view of the device.
Figure 3:
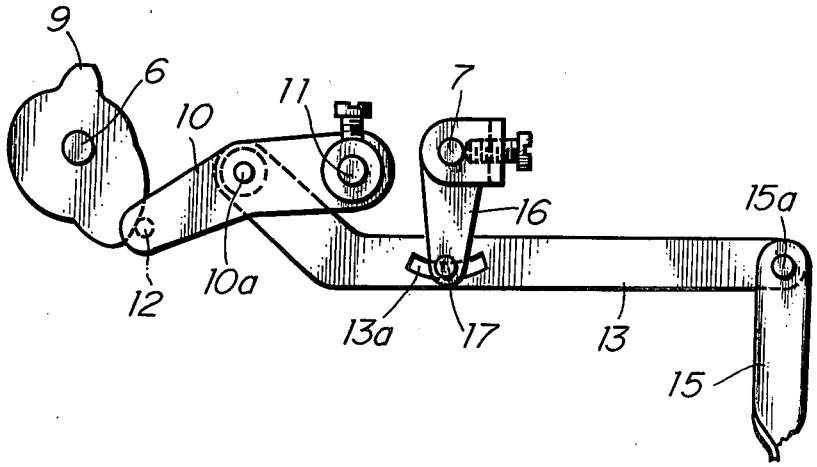
FIG. 3 is a front elevational view thereof.
Figure 4:
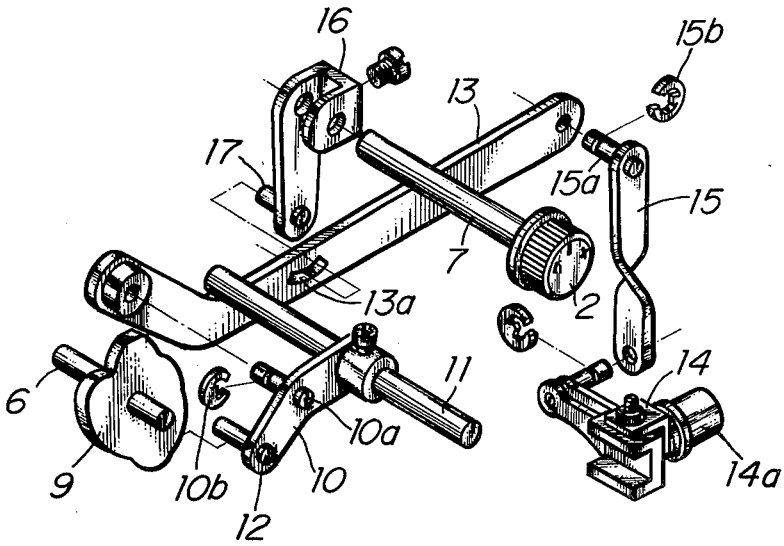
FIG. 4 is an exploded perspective view thereof.

A first embodiment of the invention will be explained with reference to FIGS. 2–4. The dials (1) and (2) are secured to the end parts of respective control shafts (6) and (7) on the outside of the machine frame (5) in which the control shafts are rotatably supported. Numeral (8) denotes in toto pattern cams each selected by operation of the dial (1) to provide various type of patterns stitched by the sewing machine. Numeral (9) is a feed control cam secured to the control shaft (6) which is operated by the dial (1) to determine the standard feed pitch most suitable for each of the various types of stitch patterns. Numeral (10) is an operating arm having one end secured to a shaft (11) which is turnably supported in the machine frame. The arm (10) has a pin (12) secured to the other end thereof and engaged to the feed control cam (9) by the action of a tension spring (not shown). Numeral (13) is a connecting rod having one end connected to a pin (10*a*) provided on the intermediate part of the operating arm (10), and prevented from movement axially of the pin by a snap ring (10*b*). The connecting rod (13) has its other end connected to a pin (15*a*) provided on the upper end of a feed adjusting rod (15) which is at its lower end connected to a feed adjuster (14), and prevented from movement axially of the pin by a snap ring (15*b*). Feed adjuster 14 is provided with a conventional pivotal support 14*a*, corresponding for example to pivotal support 37 in FIG. 4 of U.S. Pat. No. 3,053,207 issued Sept. 11, 1962. Numeral (13*a*) is an arcuate and elongate groove formed in the intermediate part of the connecting rod (13). Numeral (16) is a feed adjusting arm having one end secured to the control shaft (7) and having its other end provided with a pin (17) which is in engagement with the groove (13*a*).

Operation of this embodiment

When the dial (1) is manually rotated to select one of the pattern cams (8) in any known manner, the feed control cam (9) is operated to turn the operating arm (10) on the shaft (11). With the turning movement of the operating arm (10) the position of the pin (10*a*) is displaced. Therefore the connecting rod (13) is turned around the pin (17) to displace the position of the pin (15*a*) on the feed adjusting rod (15). Thus the inclination angle of the feed adjuster (14) is now set to provide a predetermined feed pitch. After that, if dial (2) is additionally rotated, the position of the pin (17) is displaced along the groove (13*a*) to turn the connecting rod (13) around the pin (10*a*), thereby to further displace the position of the pin (15*a*). Therefore, the inclination angle of the feed adjuster (14) is further changed to modify the just predetermined feed pitch.

Figure 5:
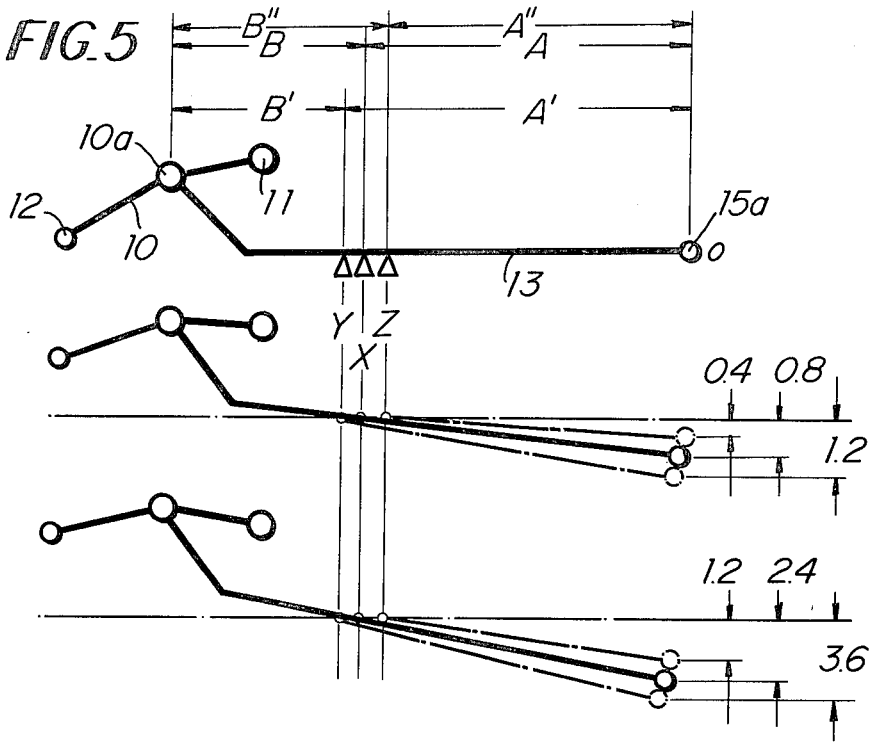
FIG. 5 is an explanatory diagrammatic view of this invention.

In reference to FIG. 5, X, Y and Z indicate the positions of the pin 17 determined by operation of the dial (2). A, A′ and A″ indicate the distances between the pin (15*a*) and the positions X, Y and Z respectively, and B, B′ and B″ indicate the distances between the pin (10*a*) and the positions X, Y and Z respectively. In order that the feed pitch can be set to zero (e.g., because during the formation of buttonhole bar-tack stitches the cloth is not to advance during stiching), the configurations of the control cam (9) and the groove (13*a*) are so formed as to set the feed pitch to zero irrespective of the positions of the pin (17) in the groove (13*a*).

The position X of the pin (17) determines the displacement of the pin (15*a*) from the position corresponding zero feed pitch. According to this invention, this displacement of the pin (15*a*) is set to determine the inclination angle of the feed adjuster, which produces the standard or automatically selected feed pitch for the selected pattern. The position Y of the pin (17) increases the displacement of the pin (15*a*) from the position corresponding to zero feed pitch approximately with the ratio of (A'/B')/(A/B). This increased displacement of the pin (15*a*) is such as to increase the feed pitch by an amount equal to an additional 50% of the standard feed pitch. The position Z of the pin (17), on the other hand, decreases the displacement of the pin (15*a*) from the position corresponding to zero feed pitch approximately with the ratio of (A''/B'')/(A/B). This decreased displacement amount of the pin (15*a*) is such as to decrease the feed pitch by an amount equal to 50% of the standard feed pitch.

According to this invention, as shown in FIG. 5, for example, if the standard feed pitch is 0.8 mm for a selected pattern, modified feed pitches of 0.4 mm and 1.2 mm can be selectively obtained for the selected pattern by operation of the dial (2). By way of example, if the standard feed pitch is 2.4 mm for a selected pattern, modified pitches of 1.2 mm and 3.6 mm can be selectively obtained for the selected pattern.

FIGS. 6–9 show a second embodiment of this invention. The fundamental principal of the second embodiment is the same as that of the first embodiment. However, the second embodiment is of a structure partly different from that of the first embodiment. Therefore, only the different part of this embodiment will now be explained.

Figure 9:
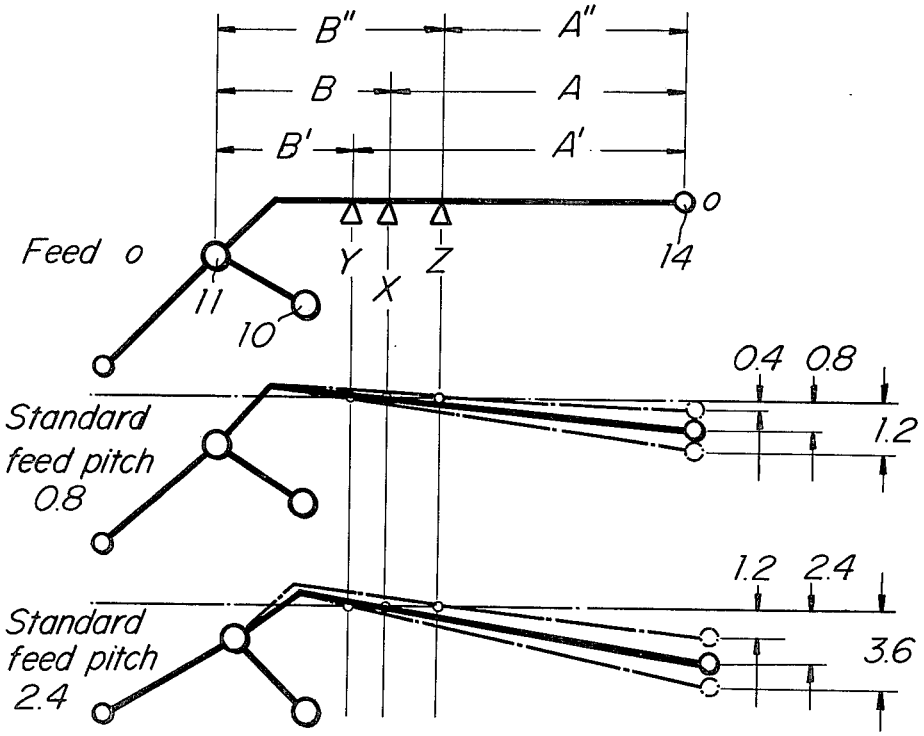
FIG. 9 is an explanatory diagrammatic view thereof.
Figure 6:
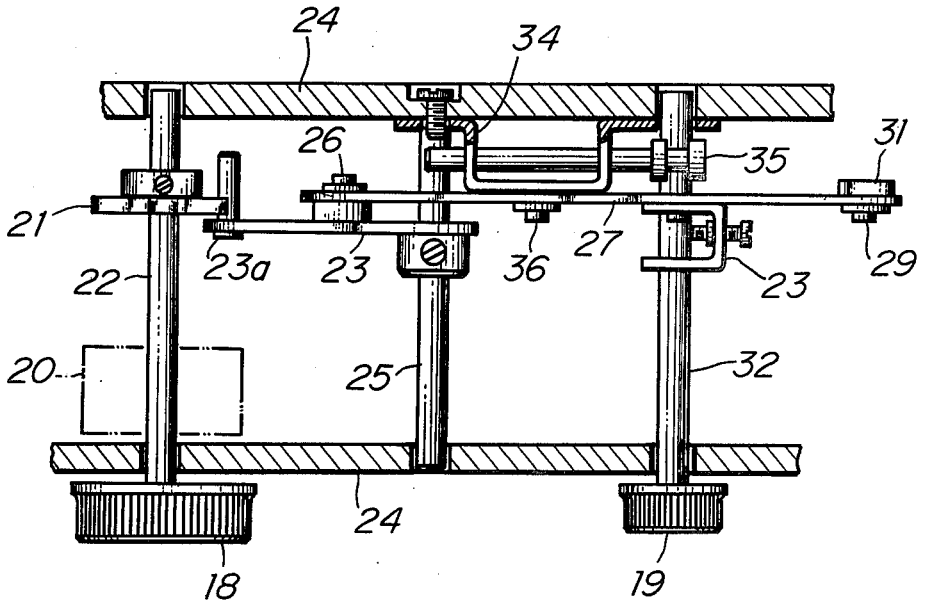
FIG. 6 is a plan view of second embodiment of this invention.
Figure 7:
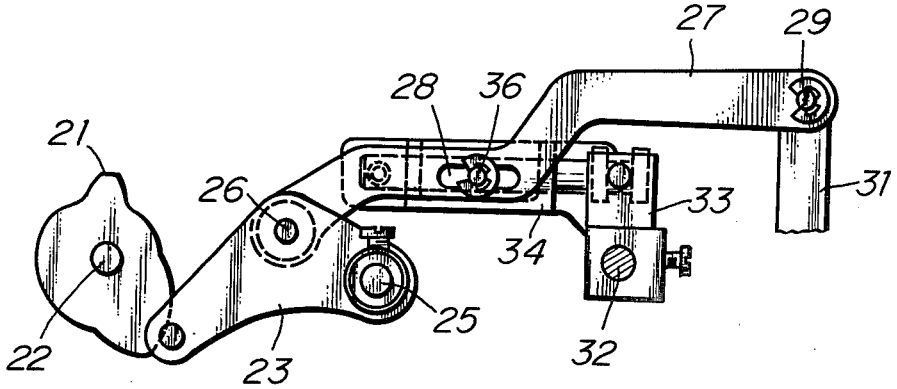
FIG. 7 is a front elevational view thereof.
Figure 8:
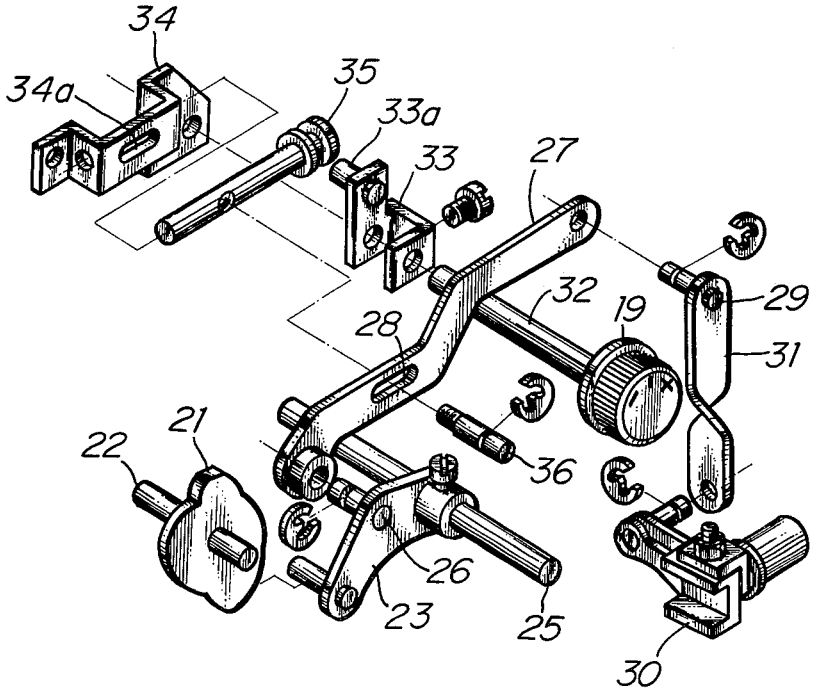
FIG. 8 is a broken perspective view thereof.

In the second embodiment of this invention, a U-shaped guide member (34) is secured to the machine frame (24) as shown. The guide member (34) is formed with a laterally elongated slot (34*a*). A shaft (35) is slidably supported across the U-shaped member. The shaft (35) has a groove formed at one end thereof and has a pin (36) secured to the intermediate part thereof. The pin (36) passes through the slot (34*a*) and through a laterally elongated slot (28) which is formed in the intermediate part of the connecting rod (27). An arm (33) is secured to the control shaft (32), and has a pin (33*a*) secured to one side thereof. The pin (33*a*) is an engagement with the groove at one end of the shaft (35). Therefore, if the dial (19) is manually rotated, the shaft (35) is axially displaced on the guide member (34), and accordingly the pin (36) is displaced along the slot (28) of the connecting rod (27) to the predetermined positions, X, Y and Z as shown in FIG. 9, where the pin (36) additionally determines the inclination angles of the feed adjuster (30) via the feed adjusting rod (31). Thus in relation to the feed control cam (21), the pin (36) determines a standard feed pitch and modified feed pitches (of ± 50% of the standard feed pitch) for a selected pattern in the same manner as in the first embodiment.

FIG. 10 shows various types of stitch patterns stitched by the sewing machine of this invention with zigzag amplitudes and standard feed pitches most suitable to the zigzag amplitudes, and the modified feed pitches variable in a range of ± 50% of the standard feed pitches.

As shown, the patterns A and B are stitched with relatively small feed pitches, and are associated with standard feed pitches of 1 mm and 0.8 mm respectively. The pattern C is stitched with a relatively large feed pitch, and is associated with a standard feed pitch of 2.4 mm. The zigzag stitches D, E, F and G are associated with standard feed pitches of 1 mm, 1.2 mm, 1.4 mm and 1.6 mm respectively which have been determined in balance with the zigzag amplitudes of these stitches. The parts H and J of the buttonhole stitches, namely the linetack stiches are associated with a standard feed pitch of 0.8 mm in the forward and backward directions. It is generally desirable that a buttonhole is produced with close stitches almost entirely covering the cloth under the stitches. Therefore it is also desirable to provide a modified smaller feed pitch of 0.4 mm for a material which is thin and easy to feed, and to provide a modified larger feed pitch of 1.2 mm for a material which is thick and difficult to feed, as shown. The bartack stitches I are associated with a standard feed pitch of 0 mm since these parts of the buttonhole are generally stitched without feeding of the material.

We claim:

1. A feed adjusting device for a sewing machine having a machine frame, a feed adjuster adjustably mounted on the machine frame and a pattern cam selecting device including a control shaft turnably mounted on the machine frame, an operating dial and pattern generating cams mounted on the control shaft, comprising a feed control cam secured to the control shaft, a follower turnably mounted on the machine frame and being in contact engagement with the feed control cam, a connection rod operatively connected between the follower and the feed adjuster, and fulcrum means fixedly arranged on the machine frame and being in engagement with the connecting rod in such a relation that when the feed control cam is operated to displace the follower by operation of the dial, the connecting rod is turned around the fulcrum means to set the feed adjuster to provide a predetermined feed pitch in response to selection of a stitch pattern, wherein the connecting rod has one end pivotally connected to the follower by a first pin, and an arcuate and elongated slot formed at the intermediate part thereof, and wherein the fulcrum means comprises a second pin engaging the slot at a predetermined position thereof.

2. A feed adjusting device for a sewing machine as defined in claim 1, wherein the fulcrums means further comprises a second control shaft turnably mounted on the machine frame, an arm secured to the control shaft and carrying the second pin, and a second operating dial secured to the second control shaft for manually operating the arm to displace the position of the second pin in the slot from the predetermined position thereof, so as to angularly displace the connecting rod around the first pin, thereby to modify the first predetermined feed pitch for the selected stitch pattern.

3. A feed adjusting device for a sewing machine as defined in claim 1, wherein the fulcrum means further comprises an element slideably mounted on the machine frame and supporting the second pin, and also formed with a groove at one end thereof.

4. A feed adjusting device for a sewing machine as defined in claim 3, wherein the fulcrum means further comprises a second control shaft turnably mounted on the machine frame, an arm secured to the control shaft and carrying a third pin which is in engagement with the groove of the slidable element, and a second operating dial for manually operating the slidable element via the arm to displace the position of the second pin in the slot from the first predetermined position thereof, so as to angularly displace the connecting rod around the first pin, thereby to modify the first predetermined feed pitch for the selected pattern.

5. A feed adjusting device for a sewing machine having a machine frame, a feed adjuster adjustably mounted on the machine frame, and a pattern cam selecting device including a control shaft turnably mounted on the machine frame, pattern generating cams and an operating dial on the control shaft, comprising a feed control cam secured to the control shaft; a follower turnably mounted on the machine frame and being in engagement with the feed control cam; a connecting rod operatively connected between the follower and the feed adjuster; fulcrum means fixedly arranged in the machine frame and being in engagement with the connecting rod in such a relation that when the feed control cam is operated by operation of the operating dial to displace the follower, the connecting rod is turned around the fulcrum means to set the feed adjuster to a predetermined position to provide a predetermined feed pitch in response to a selected pattern; and manually operated adjusting means displacing the fulcrum means relative to the connecting rod to displace the feed adjuster to a predetermined modified position relative to the predetermined set position, thereby to modify the predetermined feed pitch resulting from pattern selection.

* * * * *